United States Patent [19]

Jetter

[11] 4,352,171

[45] Sep. 28, 1982

[54] CLOCK ALARM-DEACTIVATING SYSTEM

[76] Inventor: Milton W. Jetter, 800 4th St., SW., Washington, D.C. 20024

[21] Appl. No.: 163,397

[22] Filed: Jun. 26, 1980

[51] Int. Cl.[3] ..... G04C 21/00

[52] U.S. Cl. ..... 368/73; 368/262

[58] Field of Search ..... 368/72, 73, 244, 257, 368/262, 94

[56] References Cited

U.S. PATENT DOCUMENTS

| | | | |
|---|---|---|---|
| 4,205,520 | 6/1980 | Shackford | 368/262 |
| 4,218,875 | 8/1980 | Rothman | 368/262 |
| 4,246,651 | 1/1981 | Komatsu et al. | 368/73 |

*Primary Examiner*—Bernard Roskoski

*Attorney, Agent, or Firm*—Herman L. Gordon

[57] ABSTRACT

An alarm clock with a local alarm system including a movement-operated switch, a normally-closed key-operated switch and an audible alarm device connected in series across the power lines. The switch-operating key may be remotely located so as to require the user to leave his bed in order to obtain the key, insert it in the key-operated switch, and turn the key so as to shut off the alarm. The system may include a time delay latching arrangement to prevent immediate latching the key switch open and to require the user to hold the key turned for a predetermined delay period, sufficient to produce wakefulness of the user. A signal lamp shows the delay period to be in effect until the period has been completed, thereby requiring the user to manually hold the key-operated switch open until the lamp becomes extinguished.

5 Claims, 2 Drawing Figures

CLOCK ALARM-DEACTIVATING SYSTEM

FIELD OF THE INVENTION

This invention relates to alarm clocks, and more particularly to an alarm clock system having a specially-arranged alarm-deactivating means.

BACKGROUND OF THE INVENTION

Alarm clocks have heretofore been provided with various types of deactivation mechanisms and devices for enabling a user to shut off the alarm after it has become activated. In the case of mechanical alarm clocks, manually operated stop devices have been employed. With electrically operated clocks, switch devices or various types of combined mechanical and electrical alarm-deactivation means have been employed. In practically all of the previously employed alarm-deactivation devices, the user is not required to get out of bed, and the alarm clock is usually placed conveniently within reach so that when its alarm becomes activated it can be readily reached for deactivation by the user. This turns out to be a serious disadvantage, since the alarm can be deactivated before the user is fully awake, and thus there is a great temptation to go back to sleep, since it takes a substantial period of time for an awakened person's brain to reach a fully functioning state.

Various types of quasi-remote-controlled alarm deactivation devices have been proposed, such as by verbal command, by the use of bed switches controlled by the sleeper's weight, by photoelectric systems, by touch control, and the like. Most of these deactivation devices have proved to be unsatisfactory as being excessively complicated, unreliable in operation, too expensive, and not effective to adequately awaken the user. Thus, these previously proposed devices do not require a sufficient amount of physical or mental activity on the part of the user to enable him or her to become fully awake by the time the process of deactivating the alarm is completed. The time factor and the physical activity factor are quite important, since physical activity increases the blood circulation rate and assists the person's brain to reach a fully functional condition by the time the alarm is deactivated, especially when reaching such functional condition requires a substantial degree of concentration.

Therefore, a large percentage of prior clock alarm systems fail in their underlying purpose in that individuals learn to defeat these systems without being fully awake, and these individuals become accustomed to routinely going back to sleep after turning off the alarm. For this reason there is a definite need for an alarm deactivation system requiring a behavior pattern which ensures that the individual becomes fully awake by the time the alarm is completely deactivated.

A preliminary search of the prior art revealed the following prior U.S. patents of interest:

Newman, U.S. Pat. No. 2,239,160
Belich, U.S. Pat. No. 2,496,373
Dias, U.S. Pat. No. 3,005,919
Atkins et al, U.S. Pat. No. 3,081,594
Kleinerman, U.S. Pat. No. 3,320,739
McLeod et al, U.S. Pat. No. 3,498,047
Welty, U.S. Pat. No. 3,855,574
Scheer et al, U.S. Pat. No. 4,084,104
Yamazaki et al, U.S. Pat. No. 4,121,414

SUMMARY OF THE INVENTION

The alarm clock system of the present invention includes a clock with a local alarm system and with a turn-off switch device which requires a special mode of operation, including substantial physical activity and mental concentration. A typical arrangement according to the present invention involves the use of a normally-closed key-operated switch connected in the clock alarm circuit. The switch-operating key may be intentionally located in a relatively remote place, such as in another room, or in a remote location in the same room, requiring the user to get out of bed, walk to the place where the key is located, obtain the key, return to the bed, insert the key, and then rotate the key to its switch-opening position. In another typical arrangement according to this invention, the turn-off switch device, either in the form of a key-operated switch or any other suitable manually-operated switch, is incorporated in a timed switching circuit which can effectively deactivate the clock alarm only by manually holding thr switch in its operative state for a predetermined time period, such as about 12 seconds, or any other designated time period sufficient to enable the user to reach a functionally awakened condition. The alarm switching circuit may include a lamp or other suitable indication device, which becomes energized at the start of the predetermined time period and automatically becomes deenergized at the end of said designated manual holding period, thus informing the user that the alarm has been deactivated and that he can then release the alarm circuit deactivator.

Accordingly, a main object of the present invention is to overcome the deficiencies and disadvantages of the previously proposed clock alarm deactivation systems.

A further object of the invention is to provide a novel and improved, relatively simple, electrical clock alarm control system which can be employed in a manner to require a user to exert a substantial amount of physical effort and mental concentration to deactivate the associated clock alarm and to ensure that the user reaches a wakeful state as a result of the deactivation procedure, thereby successfully achieving the intended purpose of the alarm.

A still further object of the invention is to provide an improved clock alarm system which has an alarm deactivation circuit including a normally-closed key-operated switch, and which can be employed so as to make it necessary for the user to get out of bed and obtain the switch key and employ same to open the switch in order to deactivate the alarm.

A still further object of the invention is to provide an improved clock alarm system which has an alarm deactivating circuit including control switch means and delay means for preventing effective deactivation of the clock alarm unless the control switch means is manually continuously actuated for a predetermined length of time, thereby ensuring that the user reaches a wakeful state by the time that effective deactivation of the alarm is achieved.

A still further object of the invention is to provide an improved clock alarm deactivation system which employs relatively simple and inexpensive components, which is safe to use, which is extremely economical in energy consumption, and which requires the user to employ an alarm deactivation procedure which will bring him to a wakeful state by the conclusion of said procedure.

A still further object of the invention is to provide an improved clock alarm deactivation system which may be used in a variety of different ways to ensure that the user reaches an awakened state by the time the clock alarm is effectively deactivated, for example, by requiring that the user leave his bed in order to obtain a key for switching off the alarm, whereby a substantial amount of physical effort and of mental concentration are required, or optionally, merely requiring the user to correctly insert and turn the key, which also requires a degree of physical effort and mental concentration, which would perhaps be sufficient in the case of some individuals to completely achieve a wakeful state.

BRIEF DESCRIPTION OF THE DRAWINGS

Further objects and advantages of the invention will become apparent from the following description and claims, and from the accompanying drawings, wherein:

DETAILED DESCRIPTION OF PREFERRED EMBODIMENTS

Figure 1:
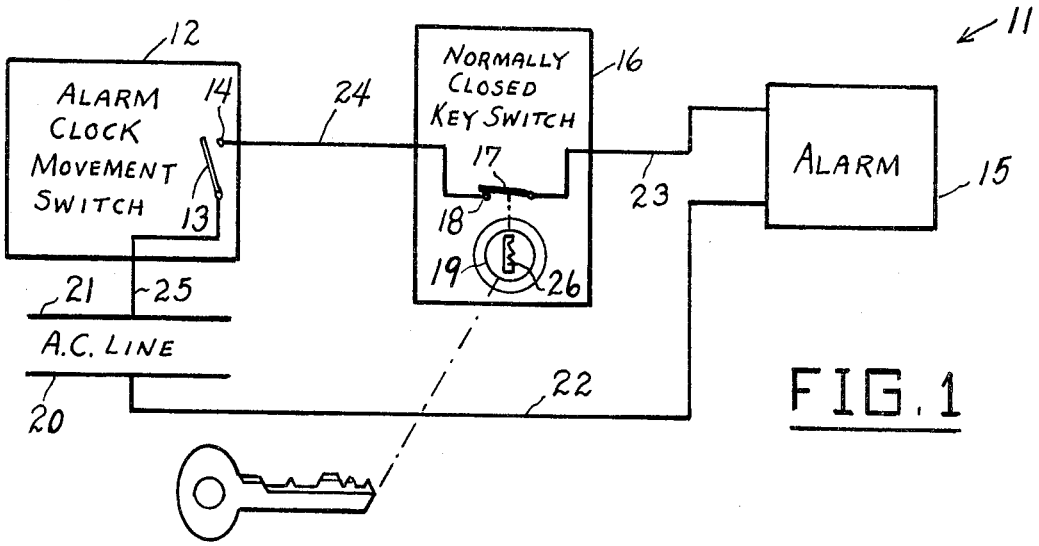
FIG. 1 is a schematic wiring diagram illustrating a relatively simple form of clock alarm deactivation system constructed in accordance with the present invention.

Referring to the drawings, FIG. 1 illustrates a typical clock alarm control system according to the present invention, generally designated at 11. The system 11 comprises a conventional electrical alarm clock provided with an alarm switch assembly 12 driven by the clock movement, said switch assembly including switch contacts 13, 14. The alarm clock can be set so as to close the contacts 13, 14 at a desired predetermined time. The system includes an electrically operated audible alarm device 15 and a key-operated switch unit 16 having normally closed switch contacts 17, 18 and a cylinder lock 19 with a keyhole 26, for opening the contacts 17, 18 responsive to the insertion of a suitable key into the keyhole and the subsequent rotation thereof.

The components 12, 16 and 15 may form part of a unitary clock assembly, with the key switch portion 16 suitably located so that the lock 19 is conveniently accessible for insertion of the deactivation key, or alternatively, the key switch assembly may be located outside the main clock housing.

The alarm assembly 15 is suitably connected to power supply wires, shown at 20, 21, through the alarm clock movement switch contacts 13, 14 and the key-controlled switch assembly 16. Thus, one terminal of alarm assembly 15 is connected by a wire 22 to line wire 20 and the other terminal of said alarm assembly is connected to line wire 21 via a wire 23, normally-closed key switch contacts 17, 18, a wire 24, alarm contacts 13, 14 and a wire 25.

The deactivation key is preferably located at a relatively remote walking distance from the bed, for example, in a remotely spaced part of the bedroom, or in another room. When the alarm contacts 13, 14 are closed by the action of the clock switching mechanism at the preset alarm time, the alarm circuit is closed and the sounding device 15 becomes energized. In order to deactivate the device 15, the user must get out of bed, walk to the place where the key is located, obtain the key, return to the bed, insert the key into the keyhole 26, and rotate the cylinder 19 so as to open the contacts 17, 18. This procedure requires a sufficient amount of physical exertion and mental concentration to ordinarily bring the user to a substantially fully awakened state, and to attenuate the user's inclination to go back to sleep.

In many instances the mere effort of properly inserting the key into the keyhole 26 of the cylinder lock 19 requires a sufficient degree of mental concentration and enough time to bring the user to a substantially fully awakened state. Thus, in such instances, the user may merely keep the key near the clock, available for its insertion into the keyhole 26 and subsequent rotation to open the switch contacts 17, 18 in response to the sounding of the alarm device 15. The user therefore may choose the appropriate place to keep the key, in accordance with his personal awakening requirements.

Figure 2:
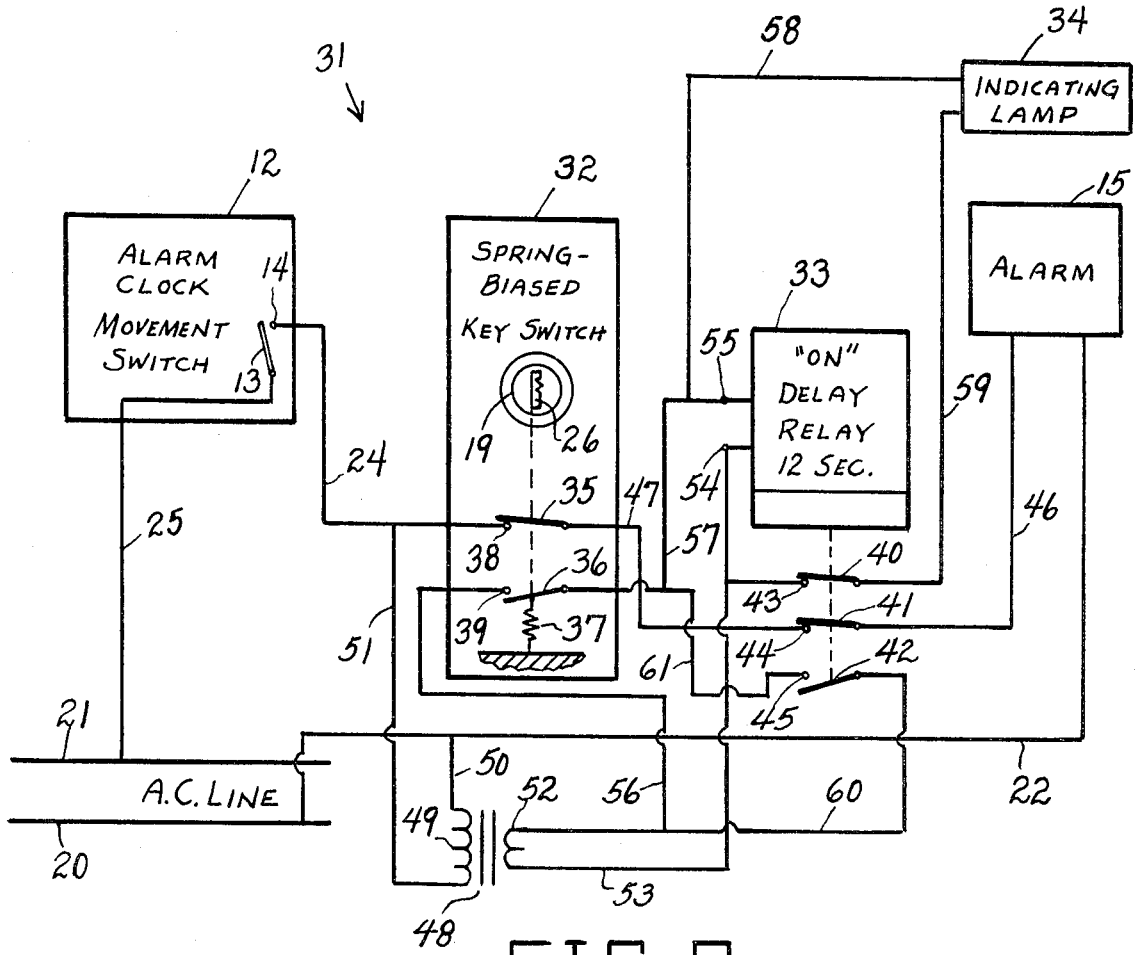
FIG. 2 is a schematic wiring diagram of another form of clock alarm deactivation system according to the present invention, wherein effective deactivation of the alarm is obtained only by continuous manual switch operation over a predetermined period of time.

FIG. 2 illustrates an alternate embodiment of the present invention, wherein a positive period of user concentration is required in order to effectively deactivate the alarm sounding device 15. The alarm control system of FIG. 2 is designated generally at 31. The system 31 comprises the alarm clock movement-driven switch assembly 12, a spring-biased 2-pole key switch assembly 32, a 3-pole "on" delay A.C. relay 33, an indicating lamp 34, and the sounding alarm device 15.

The spring-biased key switch assembly 32 has a cylinder lock 19 with a keyhole 26. The cylinder lock 19 is operatively connected to respective switch poles 35, 36, biased downwardly by a spring 37. Upper switch pole 35 normally engages a stationary contact 38. Lower switch pole 36 is normally disengaged from a stationary contact 39 but is elevated into engagement therewith when the cylinder 19 is rotated by its key, at which time upper pole 35 is disengaged from contact 38. The user must exert holding torque on the key to maintain pole 35 disengaged from contact 38 and pole 36 engaged with contact 39.

Switch unit 32 is generally similar to conventional key-operated automobile starting switches wherein the operator must exert holding torque on the ignition key in order to energize the engine starting motor.

The "on" delay relay unit 33 may comprise a conventional A.C. delay relay, and has respective poles 40, 41 and 42. Poles 40 and 41 normally engage respective contacts 43 and 44. The lower pole 42 is normally disengaged from its associated contact 45, but is engageable therewith when the relay completes its energization delay period, at which time upper poles 40 and 41 disengage from their respective stationary contacts 43, 44.

Relay unit 33 is generally similar to and may be replaced by conventional solid-state relay timing circuits, such as those employing uni-junction transistors, or provided with SCR devices, shown, for example, on pages 320 and 321 of "G.E. Transistor Manual", 7th Edition, 1964, published by General Electric Co., Syracuse, N.Y. The delay relay unit 33 may include suitable conventional internal rectifier circuit means to permit A.C. operation.

The alarm device 15 has one terminal connected to line wire 20 by wire 22 and its other terminal is connected to line wire 21 via a wire 46, normally closed relay contacts 41, 44, a wire 47, normally closed switch contacts 35, 38, wire 24, movement switch contacts 13, 14, and wire 25. Device 15 thus becomes energized by the closure of movement switch contacts 13, 14 at the alarm time set for the clock.

A step-down transformer 48 has its primary winding 49 connected across wire 22 and wire 24 by wires 50 and 51. The secondary winding 52 has one terminal connected by a wire 53 to one input terminal 54 of relay unit 33. The remaining secondary terminal is connected to the other input terminal 55 of relay unit 33 via a wire 56, normally open switch contacts 39, 36, and a wire 57.

The indicating lamp 34 has one terminal connected to wire 57 via a wire 58, and its remaining terminal connected to wire 53 via a wire 59 and normally closed relay contacts 40, 43.

Relay unit 33 is provided with a "stick" circuit connected across wires 56 and 57 (and key switch contacts 36, 39) comprising a wire 60, normally open relay contacts 42, 45, and a wire 61.

In operation, alarm device 15 becomes energized by the closure of movement-actuated switch contacts 13, 14, as above described. This also energizes transformer primary 49. The user then obtains the key, inserts it in the keyhole 26, and rotates the key, thereby opening switch contacts 35, 38 and closing switch contacts 36, 39. This stops the alarm device 15 and energizes the delay relay unit 33 via a circuit comprising secondary winding 52, wire 56, switch contacts 39, 36, wire 57, the relay operating circuit, and wire 53. At the same time, indicating lamp 34 becomes energized via wire 56, contacts 36, 39, wire 57, wire 58, the lamp filament, wire 59, closed relay contacts 40, 43, and wire 53.

The user must hold the key rotated for a designated time corresponding to the delay period of the relay unit, for example, 12 seconds. At the end of this delay period, contacts 40, 43 and 41, 44 open and contacts 42, 45 close. The closure of contacts 42, 45 latches the relay unit 33 "on", since it shunts the key switch contacts 36, 39. Lamp 34 becomes extinguished by the opening of contacts 40, 43, informing the user that the required key holding period has been completed, thereby allowing him to release his grip on the key. The alarm device 15 is latched silent by the opening of relay contacts 44, 41. The alarm device 15 is thus effectively deactivated even though the total period of closure of the clock movement-operated contacts 13, 14 has not been completed. When the clock movement re-opens contacts 13, 14, primary winding 49 becomes deenergized, resetting relay unit 33 to its normal deenergized condition.

The "on" delay relay 33 is of a type which resets to its starting condition whenever its energization is interrupted, including before the completion of its latching time period, namely, before the end of the 12 seconds required to latch it "on". Therefore, if the user releases the key before such completion, the contacts 36, 39 open, causing the relay unit 33 to reset. Thus, in order to latch the relay "on" the user must again operate the key and start a new 12-second latching period, the alarm 15 being turned off by the opening of the contacts 38, 35 while the key is being operated.

Although the specific embodiment of the basic form of the invention shown in FIG. 1 employs a key-operated switch as the alarm turn-off device, any other type of alarm turn-off device requiring a special mode of operation may be employed, within the spirit of the invention. For example, a combination lock type of switch or a Touch Tone switch system may be employed as the alarm turn-off device. The Touch Tone switch system requires the user to activate a group of push buttons in a specific sequence, similar to dialing a number in a Touch Tone telephone system. This involves a substantial degree of mental concentration, ordinarily sufficient to enable the user to reach a functionally awakened condition.

Although certain specific embodiments of improved alarm clock deactivation systems have been disclosed in the foregoing description, it will be understood that various modifications within the scope of the invention may occur to those skilled in the art. Therefore it is intended that adaptations and modifications should and are intended to be comprehended within the meaning and range of equivalents of the disclosed embodiments.

What is claimed is:

1. In an alarm clock system, clock movement-actuated alarm-activating means, alarm sounding means, and circuit means to energize the alarm sounding means responsive to operation of said movement-actuated means, said circuit means including normally-closed key-controlled turn-off switch means having a removable key, said key being manually insertable at times in the turn-off switch means for operating said turn-off switch means to open condition, means to latch the key-controlled switch means in open condition, means to provide a predetermined time delay period during which the key must be held by the user after insertion to keep the switch means open between the initial operation of said key-controlled switch means and said latched-open condition, said alarm sounding means being deenergized immediately responsive to the manual operation of said key-controlled turn-off switch means and being maintained deenergized while the turn-off switch means is manually continuously held open during said time delay period, visual indicating means, and circuit means to provide display by said visual indicating means during said time delay period and to turn off said indicating means at the end of said time delay period.

2. The alarm clock system of claim 1, and wherein said key-controlled turn-off switch means is connected in series with said movement-actuated means and said alarm sounding means.

3. The alarm clock system of claim 1, and wherein said key-controlled turn-off switch means is provided with normally-closed switch contacts connected in series with said movement-actuated means and said alarm sounding means.

4. The alarm clock system of claim 1, and wherein said indicating means comprises an indicating lamp.

5. The alarm clock system of claim 1, and spring means biasing said turn-off switch means to a closed condition.

* * * * *